US009845803B2

(12) United States Patent
Kösters et al.

(10) Patent No.: US 9,845,803 B2
(45) Date of Patent: Dec. 19, 2017

(54) SCREW PUMP

(71) Applicant: Sterling Industry Consult GmbH, Itzehoe (DE)

(72) Inventors: Heiner Kösters, Itzehoe (DE); Jörg Temming, Kölln-Reisiek (DE)

(73) Assignee: Sterling Industry Consult GmbH, Itzehoe (DE)

( * ) Notice: Subject to any disclaimer, the term of this patent is extended or adjusted under 35 U.S.C. 154(b) by 189 days.

(21) Appl. No.: 14/409,002

(22) PCT Filed: Jun. 12, 2013

(86) PCT No.: PCT/EP2013/062177
§ 371 (c)(1),
(2) Date: Sep. 30, 2015

(87) PCT Pub. No.: WO2014/001089
PCT Pub. Date: Jan. 3, 2014

(65) Prior Publication Data

US 2016/0053761 A1 Feb. 25, 2016

(30) Foreign Application Priority Data

Jun. 28, 2012 (EP) ..... 12174029

(51) Int. Cl.
*F04C 18/08* (2006.01)
*F04C 23/00* (2006.01)
*F04C 18/16* (2006.01)

(52) U.S. Cl.
CPC ..... *F04C 23/003* (2013.01); *F04C 18/084* (2013.01); *F04C 18/086* (2013.01);
(Continued)

(58) Field of Classification Search
CPC ..... F04C 18/16; F04C 18/086; F04C 18/084
(Continued)

(56) References Cited

U.S. PATENT DOCUMENTS 3,057,665 A * 10/1962 Zalis ..... F04C 2/16 406/100
4,952,125 A 8/1990 Nagai
(Continued)

FOREIGN PATENT DOCUMENTS

CN 1330972 A 1/2002
CN 1884834 A 12/2006
(Continued)

OTHER PUBLICATIONS

International Preliminary Report on Patentability dated Dec. 31, 2014 (PCT/EP2013/062177).
(Continued)

*Primary Examiner* — Mark Laurenzi
*Assistant Examiner* — Anthony Ayala Delgado
(74) *Attorney, Agent, or Firm* — Alix, Yale & Ristas, LLP

(57) ABSTRACT

The invention relates to a screw pump having two screws, in which screw pump each screw has a first thread and a second thread. The threads extend in each case from a suction side to a delivery side. The threads are in engagement with one another, with the result that the threads are divided into a plurality of working chambers, the volume of which decreases from the suction side to the delivery side. According to the invention, the threads have two thread turns. Moreover, the invention relates to a screw for a pump of this type. On account of the uniform distribution of mass of the two-turn threads, the pump can be operated at a high rotational speed, with the result that the throughput of the pump is increased.

13 Claims, 4 Drawing Sheets

(52) U.S. Cl.
CPC ..... *F04C 18/16* (2013.01); *F04C 2220/12* (2013.01); *F04C 2230/605* (2013.01); *F04C 2240/402* (2013.01)

(58) Field of Classification Search
USPC ..... 418/201.1, 9, 210, 215, 216
See application file for complete search history.

(56) References Cited

U.S. PATENT DOCUMENTS

| | | | | |
|---|---|---|---|---|
| 5,064,363 | A | 11/1991 | Nagai | |
| 5,709,537 | A * | 1/1998 | Maruyama | F04C 18/084 417/410.4 |
| 5,934,891 | A | 8/1999 | Pelto-Huikko | |
| 6,359,411 | B1 | 3/2002 | Kosters et al. | |

FOREIGN PATENT DOCUMENTS

| | | | |
|---|---|---|---|
| DE | 2117223 | A1 | 10/1972 |
| DE | 19522559 | A1 | 1/1997 |
| DE | 19748385 | A1 | 5/1999 |
| JP | H02305393 | A | 12/1990 |

OTHER PUBLICATIONS

International Search Report dated Nov. 26, 2013 (PCT/EP2013/062177).

* cited by examiner

SCREW PUMP

BACKGROUND

The invention relates to a screw pump having two screws. Each screw is equipped with a first thread and a second thread, the threads extending in each case from a suction side to a delivery side. The threads are in engagement with one another, with the result that the threads are divided into a plurality of working chambers. The volume of the working chambers decreases in each case from the suction side to the delivery side. Moreover, the invention relates to a screw for a pump of this type.

Screw pumps of this type can be used for generating a vacuum. The space to be evacuated is connected to the suction side of the pump, with the result that the pump can suck in gas from the space. The gas is compressed in the pump and is output again on the delivery side at a higher pressure.

Said screw pumps have a number of advantageous properties and are therefore widely used. However, the throughput is restricted in comparison with other pumps, that is to say the capability of discharging a great volume of gas from a space within a short time period. For applications, in which this is required, screw pumps have not previously been taken into consideration as a rule on account of their lack of throughput. Instead, other types of pumps are used, such as Roots pumps.

SUMMARY

The invention is based on the object of proposing a screw pump with an increased throughput. Proceeding from the prior art cited at the outset, the object is achieved by the features of claim 1. Advantageous embodiments are found in the subclaims.

According to the invention, the threads have in each case two thread turns. The thread turns are preferably symmetrical with respect to one another in the radial direction. The threads then have a point symmetry such that the thread turns can be copied onto themselves by a rotation about the screw axis by 180°.

The invention has discovered that the reason for the restricted throughput is, inter alia, that conventional screw pumps cannot be operated at any desired high rotational speed. A restriction of the rotational speed results from the fact that conventional screws have a non-uniform distribution of mass in relation to the screw axis. The non-uniform distribution of mass brings about an unbalance which can be kept under control only with difficulty at high rotational speeds. The distribution of mass is non-uniform because the thread turn already ensures an asymmetrical distribution of mass in the case of the normal (single-turn) threads of traditional screw pumps.

The invention proposes that the threads of the screws are of two-turn configuration. This means that each thread has two thread turns which are interlaced with one another in such a way that they together form a shape in the manner of a double helix. The two-turn threads are preferably designed in each case in such a way that the result is a symmetrical design in relation to the screw axis. For each outwardly projecting element of one thread turn, there is therefore a corresponding element of the other thread turn which lies opposite it in the radial direction in relation to the screw axis. On account of the more uniform distribution of mass of the two-turn threads in comparison with single-turn threads, it becomes possible to operate the screw pump at a higher rotational speed, with the result that the throughput is increased.

For operation at high rotational speeds, it is desirable to keep the forces as low as possible not only in the radial direction, but also in the longitudinal direction. To this end, the pump is preferably designed in such a way that the two threads of a screw work in the opposite direction. The forces which are exerted by one thread in the longitudinal direction are then compensated for by the other thread. The threads are preferably oriented in such a way that the suction side is arranged in the center of the screw, that is to say between the two threads. The delivery sides are then formed by the outer ends of the threads, which has the advantage, in particular, that the drive elements and bearings are exposed to the higher output pressure. Moreover, the screw can be designed in such a way that it also has a symmetrical design in the longitudinal direction if that section of the screw which is enclosed between the two outer ends of the threads is considered.

The pump according to the invention comprises a housing, in which the two screws are received. The housing is provided with an inlet opening in the region of the suction side, and there is an outlet opening in the region of the delivery side. It has been shown that it is of significance for a high throughput of the pump to design the inlet opening and the suction side of the pump in such a way that a high volumetric flow can enter into the pump.

The housing is preferably designed in such a way that it has a first housing section and a second housing section in the region of a thread, there being a suction gap between the housing and the thread in the first housing section, and the housing sealing with the thread in the second housing section. The fact that the housing seals with the thread is to be understood in such a way that the leakage gap which necessarily exists between the housing and the thread in the case of dry-running pumps is as small as possible (minimum radial spacing). Nowadays, a value of less than 0.2 mm, preferably approximately 0.1 mm is the aim for the minimum radial spacing. Since the two screws of the pump are in engagement with one another, the housing in the first housing section does not seal with the thread over the entire circumference of the screw, but rather only in the circumferential section, in which there is no engagement with the other screw. The second housing section preferably adjoins the delivery side of the thread.

The inlet opening of the housing is as a rule also arranged in the region of the first housing section which preferably adjoins the suction side of the thread. The screw is then surrounded by the housing only in the circumferential section which still remains next to the inlet opening and the second screw. If there is a suction gap between the housing and the thread in the first housing section, this is to be understood in such a way that there is a radial spacing between the thread and the housing in at least one part section of said circumferential section, which radial spacing is greater than the minimum radial spacing. The radial spacing in the region of the suction gap is preferably greater than the minimum radial spacing by at least the factor 50, preferably the factor 100, further preferably the factor 200.

The suction gap has the effect that the gas which is sucked in can enter the working chambers not only in the radial direction, but can also move through the suction gap from one working chamber into the next working chamber. By an additional path into the working chamber being offered to the gas, the working chamber can be filled more rapidly, which has a positive effect on the throughput.

The greater the suction gap, the more gas can enter into the working chambers along this path. The suction gap preferably extends next to the inlet opening in the circumferential direction over at least 10%, preferably at least 20%, further preferably at least 30% of the circumferential section, with which the housing in the second housing section surrounds the screw. In the region, in which there is no longer any overlap between the suction gap and the inlet opening, the suction gap can extend over a correspondingly greater circumferential section of, for example, at least 50%.

In the longitudinal direction, the suction gap preferably extends over at least 20%, further preferably over at least 30%, further preferably over at least 40% of the length of the thread. Accordingly, the second housing section is considerably shorter than the length of the thread and extends, for example, over no more than 80%, preferably no more than 70%, further preferably no more than 60% of the length of the thread. In contrast to conventional pumps, a comparatively long section of the thread therefore serves to fill the working chambers, whereas the section, in which the compression takes place, that is to say in which the housing seals with the thread, is comparatively short. The extent of the suction gap in the longitudinal direction can correspond substantially to the screw section which is assumed by the first 360° winding of the thread. The thread therefore has a great lead in the inlet region. The first 360° winding as viewed from the suction side preferably assumes at least 20%, preferably at least 30%, further preferably at least 40% of the length of the thread. Overall, each thread turn of the two-turn thread preferably comprises at least three, further preferably at least four complete 360° windings.

A transition edge can be formed between the first housing section and the second housing section and therefore at the transition from the suction gap to the region[ ] in which the housing seals with the thread. As soon as the thread seals with the transition edge, the working chamber is sealed and the actual compression begins. If the transition edge were oriented parallel to the thread turn, by way of which the sealing takes place, the chamber would be sealed suddenly. This would be positive for the degree of efficiency of the pump, but also increases the noise level. The transition edge is therefore preferably oriented in such a way that it includes an angle with the circumferential direction in accordance with the thread lead, the angle being smaller than the thread lead.

In order for it to be possible to suck in great volumes, it is advantageous, furthermore, if the housing is provided with a large inlet opening. For example, the inlet opening can be greater than 60%, preferably than 80%, further preferably than 100% of the cross-sectional area of the screw. The cross-sectional area of the screw denotes the contour which is defined by the screw. Using said contour which is as a rule cylindrical, the radial spacings between the thread and the housing can also be determined.

In order to improve the filling of the working chambers further, a spacing can be provided between the inner ends of the two threads of a screw. As a result, additional space is obtained, through which the gas can also enter into the working chambers in the longitudinal direction.

The delivery sides are as a rule formed by the outer end of the threads, which means that the delivery sides are at a spacing from one another. A line is preferably provided which extends from the delivery side to an outlet opening of the pump. In one advantageous embodiment, the line is a bore which is formed between the two screws of the pump in the pump housing, the bore further preferably being arranged at least partially within a tangential face which rests on both screws.

The pump can be designed in such a way that the two screws can be detached together with the drive as one unit from the pump housing. This affords the possibility of installing the pump fixedly in a relatively large plant, it being possible, in particular, for the inlet opening and the outlet opening of the pump housing to be connected fixedly to corresponding pipelines of the plant. If maintenance or repair becomes necessary, the connections between the pump housing and the plant remain in existence and merely the unit comprising screws and drive is detached from the pump housing and replaced by another unit. As a result, long down times during maintenance and repair are avoided.

For this purpose, the screws are preferably equipped in each case with a bearing at the end which faces away from the drive, which bearing is received slidingly in a bearing seat of the pump housing. When the unit comprising screws and drive is pulled out of the pump housing, the bearing is released from the bearing seat and is also removed from the pump housing.

The pump according to the invention is preferably dimensioned in such a way that it achieves a throughput of more than 5000 $m^3/h$ and in the process can compress the gas from 1 mbar to 100 mbar. To this end, the diameter of the screws is preferably greater than 20 cm. The pump can be designed for operation at a rotational speed of more than 10 000 rpm.

By virtue of the fact that the screw pump according to the invention combines a high throughput with great compression, possible applications are opened up which were not accessible previously to the screw pumps. In order to generate a vacuum at low pressure with a simultaneously large volumetric flow, a pump arrangement comprising two pumps connected behind one another is usually used, the first pump usually being called a booster pump and the following pump being called a forepump. Connecting two pumps behind one another is expedient because, according to the gas law (pressure*volume=constant; under the assumption of a constant temperature), the forepump can be designed for a substantially smaller volumetric flow than the booster pump.

As a result of the greatly increased throughput in comparison with classic screw pumps, it becomes possible to use the screw pump according to the invention as a booster pump. As a consequence, the invention relates to a pump arrangement comprising a booster pump and a forepump, in which pump arrangement the booster pump is a screw pump according to the invention. A pump arrangement, in which a screw pump is used as booster pump, has independent inventive content, even without the threads of the screws being of two-turn configuration.

In comparison with Roots pumps which have usually been used up to now as booster pump, the screw pump according to the invention produces a considerably higher compression. If a steady-state operating state of the pump arrangement is considered, in which operating state the booster pump can suck in substantially the maximum possible volumetric flow and the pressure is kept constant at a low value of, for example, less than 1 mbar, classic single-stage Roots pumps produce merely a compression by the factor 10. The volumetric flow through the following forepump is, as a consequence, merely smaller than the volumetric flow through the booster pump by the factor 10 in accordance with the gas law.

In the steady-state operating state, in which substantially the maximum possible volume is sucked in and the pressure is kept constant below 1 mbar, the screw pump according to the invention produces a compression by at least the factor 50 or even the factor 100. This results in completely new options for the design of the pump arrangement. For instance, in the steady-state operating state which is described, the volumetric flow through the forepump can be smaller than the volumetric flow through the booster pump by at least the factor 50, preferably at least the factor 100. The volumetric flow at the inlet of the booster pump in the steady-state operating state is preferably greater than 1000 $m^3/h$, further preferably greater than 5000 $m^3/h$.

Moreover, the use of the screw pump according to the invention as booster pump opens up the option to use a liquid ring vacuum pump as forepump. The liquid ring vacuum pumps are not suitable for pressures which lie below the vapor pressure of the operating liquid. In general, said pumps can therefore not be used for pressures below 30 mbar. The screw pump according to the invention achieves an output pressure of more than 30 mbar even if the input pressure lies below 1 mbar. As a consequence, it becomes possible by way of the invention to use a liquid ring vacuum pump as forepump.

Moreover, the invention relates to a screw for a screw pump of this type. The screw comprises two threads which extend in each case from a suction side to a delivery side. According to the invention, the screw is distinguished by the fact that the threads in each case have two thread turns, the thread turns preferably being symmetrical with respect to one another in the radial direction. The screw can be developed by way of further features which are described with reference to the pump according to the invention.

BRIEF DESCRIPTION OF THE DRAWINGS

In the following text, the invention will be described by way of example using one advantageous embodiment with reference to the appended drawings, in which.

DETAILED DESCRIPTION

Figure 1:
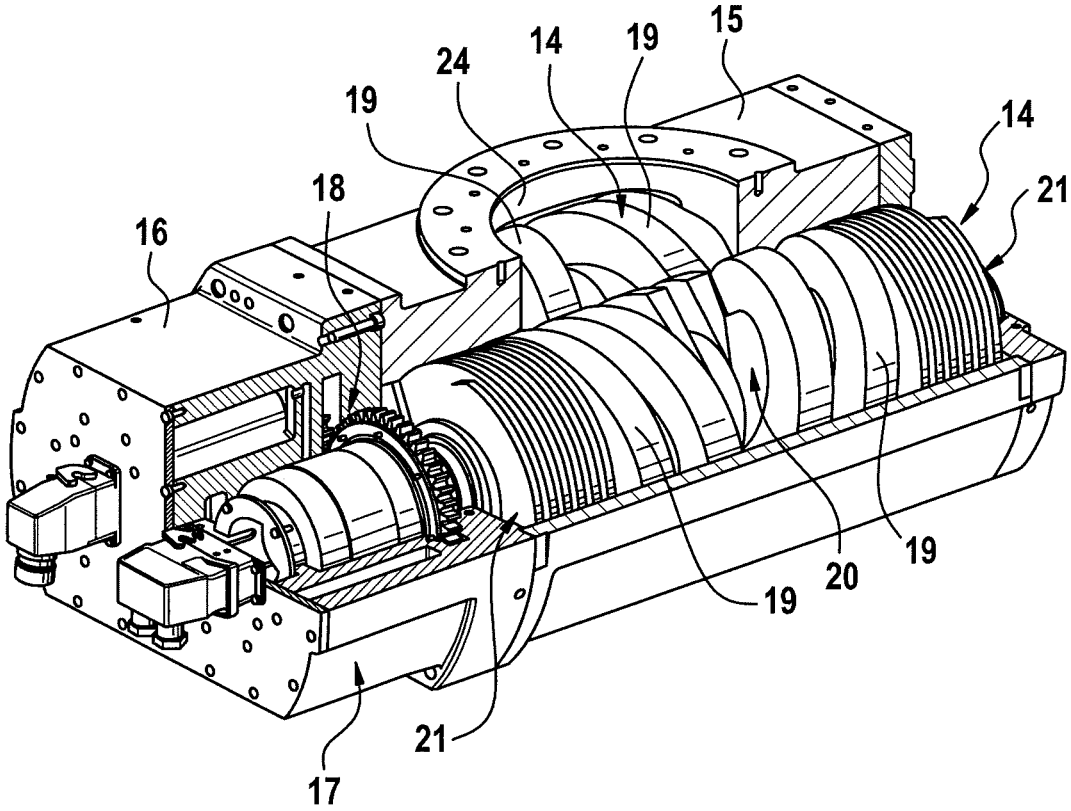
FIG. 1 shows a perspective, partially cut-away illustration of a screw pump according to the invention.

A pump according to the invention in FIG. 1 comprises two screws 14 which are received in a pump housing 15. One of the screws 14 can be seen over the entire length on account of the pump housing 15 which is not shown completely, whereas substantial parts of the other screw 14 are covered by the pump housing 15. The two screws 14 are in engagement with one another, which means that the thread projections of one screw 14 engage into the depression between two thread projections of the other screw 14.

The pump comprises a control and drive unit 16, in which an electronically controlled drive motor 17 is arranged for each of the screws 14. The electronic controller of the drive motors 17 is set up in such a way that the two screws 14 run completely synchronously with respect to one another, without the thread projections of the screws 14 coming into contact. As an additional safety measure against damage to the screws 14, the two screws 14 are equipped in each case with a gearwheel 18. The gearwheels 18 are in engagement with one another and bring about positive coupling of the two screws 14 for the case where the electronic synchronization of the screws 14 fails.

Each screw 14 is equipped with two threads 19, with the result that the pump has four threads 19 overall. The threads 19 extend in each case from a suction side 20 in the center of the screw 14 to a delivery side 21 at the outer ends of the screw 14. The two threads of one screw 14 are oriented in opposite directions, with the result that they operate from the suction side 20 toward the delivery side 21.

Each of the threads 19 comprises a first thread turn 22 and a second thread turn 23. The threads 19 are therefore two-turn in the sense that the thread turns 22, 23 are interlaced with one another, with the result that they together form a shape in the manner of a double helix. The two thread turns 22, 23 are shaped in such a way that the threads 19 are symmetrical in the radial direction. If the screw 14 is considered from the delivery side of the first thread 19 as far as the delivery side of the second thread 19, the screw 14 has, moreover, a symmetry in the longitudinal direction.

The threads 19 are designed in such a way that a greater volume between two adjacent thread projections is enclosed in the region of the suction side 20 than in the region of the delivery side 21. The volume of the working chambers which corresponds to the volume which is enclosed between the thread projections is therefore reduced from the suction side to the delivery side, with the result that gas which is contained in the working chamber is compressed on the path from the suction side to the delivery side.

The housing 15 of the pump is provided with an inlet opening 24 which is arranged in such a way that it affords access to the suction sides 20 of all four threads 19. In order to make a great volumetric flow into the pump possible, the inlet opening 24 has a great cross section. In the exemplary embodiment, the cross-sectional area of the inlet opening 24 is greater than the circular contour which is defined by a screw 14.

In order to further improve the volumetric flow into the working chambers, a suction gap 25 is formed on the housing 15 of the pump, which suction gap 25 adjoins the inlet opening 24 and follows the contour of the screw 14 in the circumferential direction. In the longitudinal direction, the suction gap 25 extends approximately over half the length of the thread 19 between the suction side 20 and the delivery side 21. In the circumferential direction, the dimension of the suction gap 25 varies with the inlet opening; the further the inlet opening 24 extends to the side at the relevant point, the shorter the extent of the suction gap 25 in the circumferential direction at said point. At the widest point of the inlet opening 24, the suction gap 25 extends over a circumferential angle of approximately 45°. In the region, in which the inlet opening 24 no longer overlaps the suction gap 25, the suction gap 24 extends over a circumferential angle of approximately 120°. The dimension of the suction gap 25 in the radial direction corresponds to the spacing between the pump housing 15 and the contour of the screw 14 in said region. This spacing lies in the order of magnitude of approximately 10 mm.

As a result of the suction gap, the gas is not restricted to entering into the working chambers in the radial direction, but rather the gas can also move beyond a thread projection through the suction gap into the working chamber. The volumetric flow into the working chamber is increased further as a result.

A further contribution to increasing the volumetric flow into the working chamber is achieved by the fact that there is a spacing between the suction side 20 of the first thread 19 of a screw 14 and the suction side 20 of the second thread 19 of the screw 14. As a result, space remains free in the center of the screw 14, through which space the gas can also enter into the working chamber in the radial direction.

The region, in which the suction gap 25 extends (=first housing section 26), serves to fill the working chambers. In the adjoining second housing section 27, the spacing between the housing and the contour of the screw 14 is as small as is technically possible (minimum radial spacing). The compression takes place in the second housing section and a leakage flow from one working chamber into the next working chamber is not desired.

A transition edge 28 is formed at the transition from the first housing section 26 to the second housing section 27. The transition edge 28 extends in the circumferential direction over the entire suction gap 25 and defines the transition from the suction gap 25 to the second housing section 27, in which the minimum radial spacing exists between the housing 15 and the screw 14.

The compression begins as soon as the working chamber has moved into the second housing section, that is to say as soon as the thread projection which delimits the working chamber towards the suction side has sealed with the transition edge 28. The transition edge 28 is arranged in such a way that the seal between the thread projection and the transition edge 28 takes place at an instant[ ] at which the working chamber still has its maximum volume.

As viewed in the circumferential direction, the transition edge 28 includes an angle with the transverse direction which is smaller than the lead of the thread projection which seals with the transition edge 28. This achieves a situation where the seal between the thread projection and the transition edge 28 does not take place suddenly, but rather extends over a short time period. The operating noise of the pump is reduced as a result.

The actual volume compression takes place in a short section of the thread immediately after the seal of the working chamber. The adjoining further windings of the thread serve for sealing and also bring about a thermodynamic compression.

Figure 2:
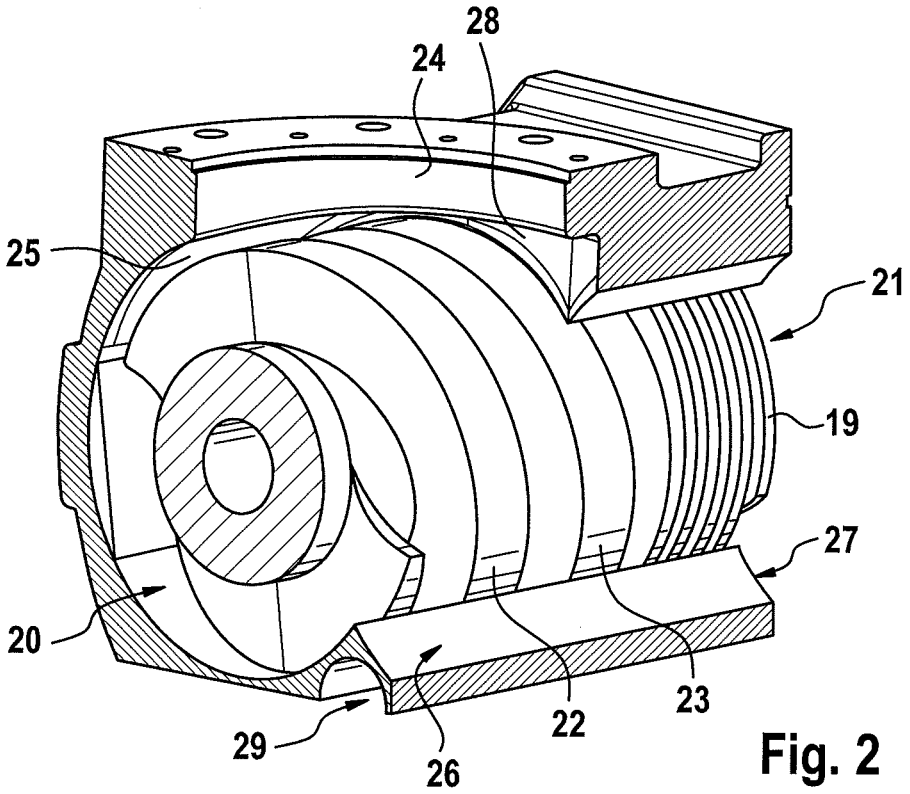
FIG. 2 shows a detail of the pump from FIG. 1 in an enlarged illustration.
Figure 3:
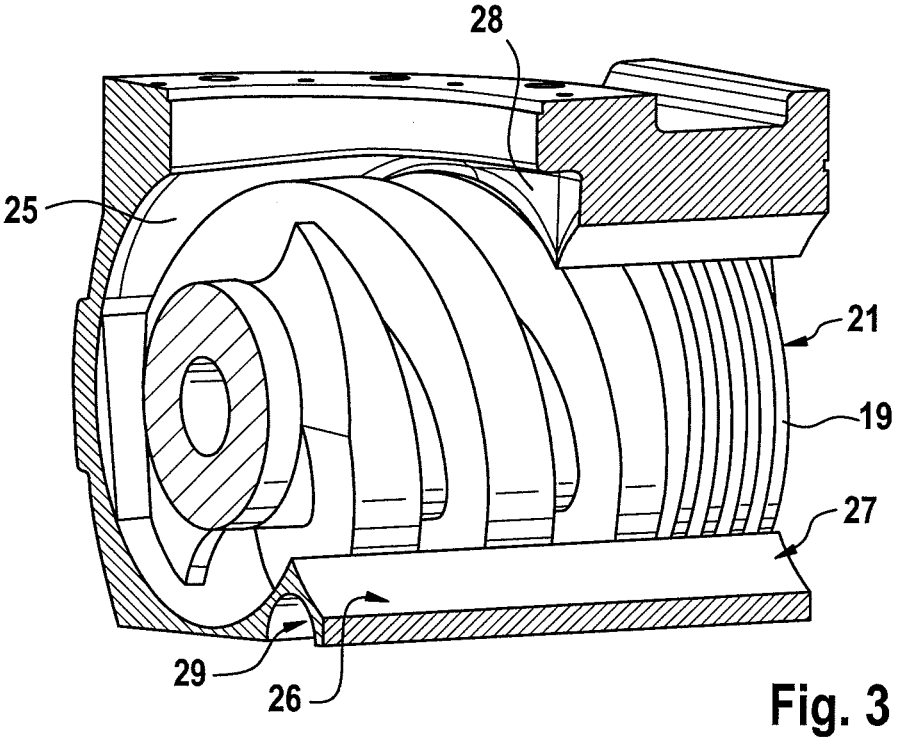
FIG. 3 shows the view from FIG. 2 in another state of the pump.
Figure 4:
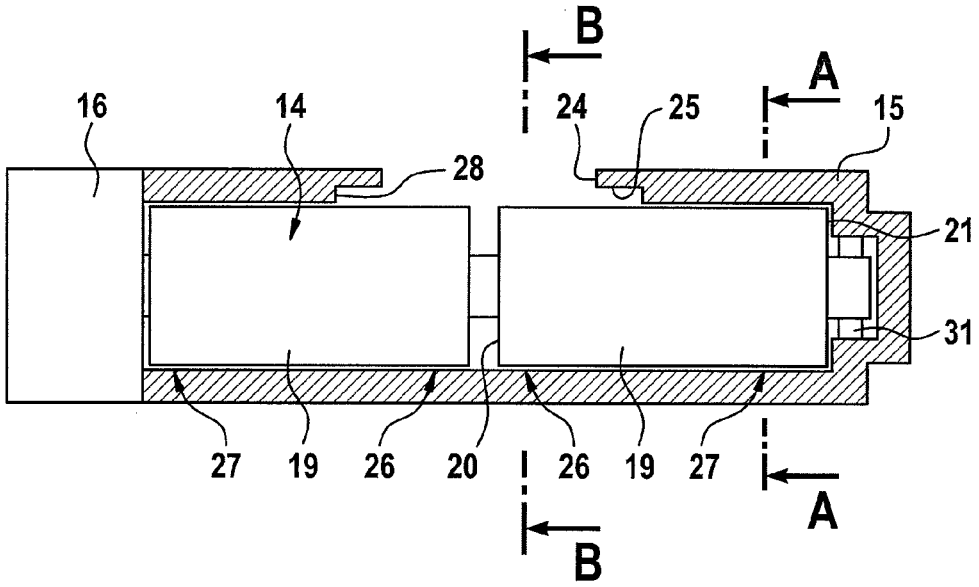
FIG. 4 shows a diagrammatic cross-sectional view of a screw pump according to the invention along the axis of a screw.
Figure 5:
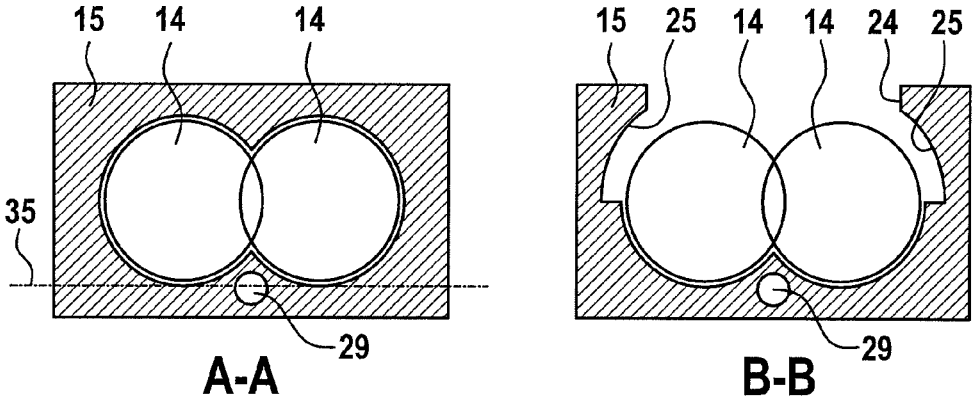
FIGS. 5A and 5B show sections along the lines A-A and B-B in FIG. 4.

The gas is discharged from the working chamber on the delivery side 21 of the thread 19. The compressed gas is combined by a bore 29 in the pump housing 15 from the outer delivery sides 21 to a central outlet opening. The outlet opening which cannot be seen in the figures is arranged opposite the inlet opening 24. As FIGS. 2, 3 and 5 show, the bore 29 is integrated into the pump housing 15 and extends between the two screws 14, the line 29 being arranged partially within a tangential plane 35 which rests on both screws 14.

Figure 6:
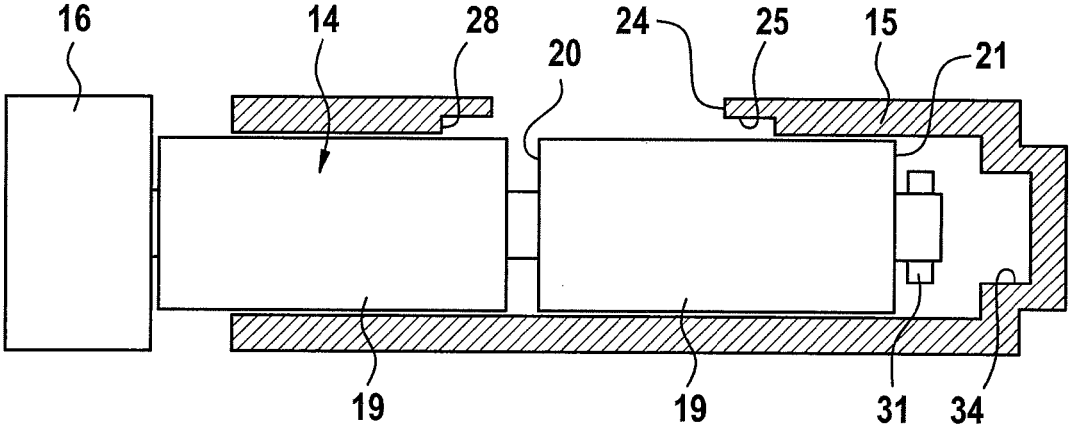
FIG. 6 shows the view from FIG. 4 in another state of the screw pump.

According to FIG. 6, the pump according to the invention is constructed in such a way that the control and drive unit 16, together with the screws 14, forms one structural unit which can be pulled as such out of the housing 15. If maintenance or repair is required, the structural unit can be exchanged, without it being necessary for the pump housing 15 to be detached from the plant surroundings.

A bearing 31 is arranged at that end of the screw 14 which faces away from the control and drive unit 16, which bearing 31 is seated fixedly on the shaft and is received slidingly in a bearing seat 34 of the pump housing 15. If the structural unit is pulled out of the housing 15, the bearing 31 is released from the bearing seat 34 and is likewise removed from the housing 15.

Figure 7:
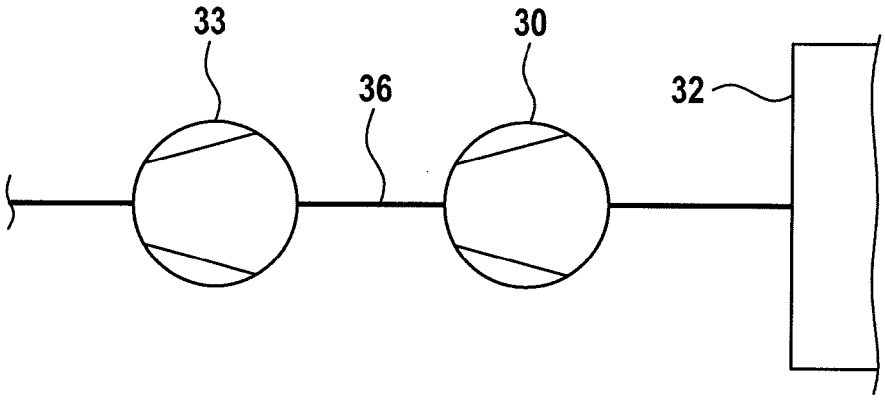
FIG. 7 shows a block diagram of an arrangement according to the invention.

One application example for a screw pump according to the invention is shown in FIG. 7, where a pump arrangement comprising a booster pump 30 and a forepump 33 is connected to a space 32 to be evacuated. The booster pump 30 is a screw pump according to the invention, and therefore the forepump 33 is a liquid ring vacuum pump. The pump arrangement is dimensioned in such a way that a volumetric flow of 4000 $m^3$/h can be sucked out of the space 32, in order to keep the pressure in the space 32 constant at 0.5 mbar.

To this end, the booster pump 30, the screws 14 of which have a diameter of approximately 25 cm, is operated at a rotational speed of approximately 15 000 rpm. A pressure of approximately 50 mbar prevails at the outlet of the booster pump 30 and therefore at the inlet of the forepump 33. According to the gas law, this means a volumetric flow of 400 $m^3$/h for the forepump 33. The forepump 33 compresses said volumetric flow to atmospheric pressure and discharges it to the surroundings.

The invention claimed is:

1. A screw pump comprising:

two screws each having first and second ends, each screw having a first thread and a second thread, each of which threads has two thread turns and extends from a suction side at a center of the screw to a delivery side at an outer end of each thread, the first thread and second thread work in opposite directions, with the delivery side of the first thread at the first end of the screw and the delivery side of the second thread at the second end of the screw, the first and second threads of one screw engage with the first and second threads of the other screw to define a plurality of working chambers having a volume that decreases from the suction side to the delivery side; and a housing in which the screws are received, said housing having a first housing section in the region of the suction side at the center of the screws and a second housing section surrounding the delivery side of the first and second threads of each screw, said first housing section defining an inlet, there being a suction gap between the housing and at least one of the first and second threads in the first housing section, and there being a minimum radial spacing between the housing and the thread in the second housing section.

2. The screw pump of claim 1, wherein the screws have a design which is symmetrical in the longitudinal direction between the two outer ends of the threads.

3. The screw pump of claim 1, wherein a radial spacing between the housing and the thread in the region of the suction gap is at least 50 times greater than the radial minimum spacing.

4. The screw pump of claim 1, wherein the extent of the suction gap in the circumferential direction corresponds to at least 10% of a circumference of the housing surrounding the screw in the first housing section.

5. The screw pump of claim 1, wherein an extent of the suction gap in a longitudinal direction corresponds to at least 20% of a length of the thread.

6. The screw pump of claim 1, wherein a transition edge is formed between the first housing section and the second housing section.

7. The screw pump of claim 1, wherein the housing is provided with an inlet opening having a cross sectional area greater than 60% of a cross-sectional area of the thread.

8. The screw pump of claim 1, wherein an inner end of the two threads of a screw are spaced apart from one another.

9. The screw pump of claim 1, wherein said housing includes a bore between the two screws which connects the delivery sides to an outlet opening, the bore being arranged at least partially within a tangential plane which rests on both screws.

10. The screw pump of claim 1, wherein the two screws and a drive form a unit that is releasably connected to the pump housing.

11. A pump arrangement comprising the screw pump of claim 1 and a forepump arranged at an outlet of said screw pump.

12. The pump arrangement of claim 11, wherein, in a steady operating state in which the screw pump sucks in substantially a maximum possible volumetric flow and a pressure at an inlet of the screw pump is kept constant at a value of less than 1 mbar, a volumetric flow through the forepump is smaller than the volumetric flow through the booster pump by at least a factor of 50.

13. The pump arrangement of claim 11, wherein the forepump is a liquid ring vacuum pump.

* * * * *